US006293415B1

(12) United States Patent
Franzke

(10) Patent No.: US 6,293,415 B1
(45) **Date of Patent: *Sep. 25, 2001**

(54) RAILBORNE MOBILE CRANE

(75) Inventor: Urban Franzke, Monheim (DE)

(73) Assignee: Mannesmann AG, Düsseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/201,332

(22) Filed: Nov. 30, 1998

(30) Foreign Application Priority Data

Nov. 28, 1997 (DE) ..... 197 54 775

(51) Int. Cl.[7] ..... B66C 23/74
(52) U.S. Cl. ..... 212/195; 105/238.1
(58) Field of Search ..... 212/178, 195, 212/196, 256, 257, 197, 198; 104/2, 3; 105/1.1, 238.1

(56) References Cited

U.S. PATENT DOCUMENTS

| | | | | |
|---|---|---|---|---|
| 1,611,970 | | 12/1926 | Wheat et al. . | |
| 1,826,069 | * | 10/1931 | Guilbert et al. | 104/2 |
| 4,018,473 | * | 4/1977 | Chalupsky | 182/63 |
| 4,113,111 | * | 9/1978 | Theuer et al. | 212/28 |
| 4,596,508 | * | 6/1986 | Kishi et al. | 414/687 |
| 5,174,211 | * | 12/1992 | Snead | 104/3 |
| 5,518,128 | * | 5/1996 | Kroll et al. | 212/196 |

FOREIGN PATENT DOCUMENTS

| | | | | |
|---|---|---|---|---|
| 34 08 957 | | 10/1984 | (DE) . | |
| 3926920 | * | 5/1990 | (DE) . | |
| 44819 | * | 1/1982 | (EP) . | |
| 285 492 | | 10/1988 | (EP) . | |
| 396310 | * | 10/1990 | (EP) . | |
| 2535359 | * | 5/1983 | (FR) | 104/3 |
| 2 700 514 | | 7/1994 | (FR) . | |
| 2488 | * | 8/1868 | (GB) | 212/195 |
| 2 184 409 | | 6/1987 | (GB) . | |
| 7304593 | * | 11/1995 | (JP) . | |
| 10016730 | * | 1/1998 | (JP) . | |

OTHER PUBLICATIONS

Article appearing in ETR (1992), H–12–Dezember entitled "SM90—ein neuer elektrischer Nahverkehrs—Triebzug für die Niederländische Staatshanh (NS)" by Ruud Boer Rookhuiszen und Rolf Schmidt, pp. 831–841.

Article entitled "Der ICE und mehr" appearing in eisenbahn magazin 9/94 pp. 15–17.

Article entitled "Flexibility Staffing" taken from Railway Gazette International 144 dated Oct. 1988, No. 10, Sutton, Surrey, Gr. Britain, p. 667.

* cited by examiner

*Primary Examiner*—Thomas J. Brahan
(74) *Attorney, Agent, or Firm*—Cohen, Pontani, Lieberman & Pavane

(57) ABSTRACT

A railborne mobile crane mounted on a chassis with a superstructure, a counterweight and a boom which are arranged so as to be swivelable about a vertical axis of the superstructure. The superstructure is contoured so as to be within a prescribed clearance gauge of a section of track. The superstructure is outfitted with a device to compensate for superelevations of curved track sections. Longitudinal sides and a rear side of the superstructure are arranged so that, in every swiveling position, all contours of the superstructure lie within a defined safety area. The safety area is bounded on each of two sides of a longitudinal axis of the crane by an inclined plane which is inclined inward from the vertical, proceeding from a lower edge of the superstructure, by an angle of inclination at least corresponding to a maximum allowable angle of superelevation of the track.

2 Claims, 4 Drawing Sheets

RAILBORNE MOBILE CRANE

BACKGROUND OF THE INVENTION

1. Field of the Invention

The present invention is directed to a railborne mobile crane with a superstructure which is arranged so as to be swivelable about a vertical axis together with a counterweight and a boom on a truck. The contours of the superstructure are arranged within a prescribed clearance gauge of a section of track. The superstructure is outfitted with a device for compensation of curve superelevations.

2. Description of the Related Art

A railborne mobile crane mounted on a truck with a superstructure arranged so as to be swivelable about a vertical axis together with a boom and a counterweight is used for working on a track and adjacent to the track. The usefulness of such a railborne mobile crane depends extensively upon construction of the crane, the boom and the counterweight. Particularly when working on lengths of track in which the track is laid parallel to an adjacent track or is within a tunnel, special steps have to be taken to maintain a necessary clearance gauge with respect to the adjacent track or tunnel wall.

When working on two-track or multi-track stretches, it must be ensured that under all circumstances, for reasons of safety, no parts of the crane that jut out, such as parts of the counterweight, swivel into the prescribed clearance gauge of the adjacent track. Various crane constructions are known in which contours of the superstructure remain, during the use of the crane, within the prescribed clearance gauge of the track section.

A dangerous situation arises however when the crane contours conform to the prescribed clearance gauge but, because of superelevation of the track along curves, a railborne vehicle traveling on the adjacent track is inclined toward one side, and therefore enters the clearance gauge area of the railroad mobile crane.

During use, the railroad crane is usually oriented to the horizontal for purposes of maintaining stability and a preferred center of gravity. A curve superelevation compensation device is provided for horizontally orienting the crane on a superelevated i.e. curved or canted, section of track. The compensation device pivots the superstructure with the boom and the counterweight relative to the truck of the crane until the swiveling axis of the crane extends vertically. However, as a result of this righting of the crane relative to the length of track, the contour of the superstructure is shifted into the prescribed clearance gauge of the adjacent track so that a collision will occur with a railborne vehicle traveling on the adjacent track.

SUMMARY OF THE INVENTION

It is an object of the present invention to provide a railborne mobile crane having a superstructure with a boom and a counterweight mounted on a chassis, that is safe for use on lengths of superelevated track without limiting load carrying capacity.

According to the present invention, two longitudinal sides and a rear side (i.e. the counterweight side) of the superstructure are arranged so that all contours of the superstructure lie within a safe area, in every swiveling position. The safe area is defined at each of two sides of a longitudinal axis of the crane by a respective imaginary plane while the sides of the superstructure are inclined inward from vertical, proceeding from a lower edge of the superstructure, by an angle of inclination at least corresponding to an angle of maximum allowable track superelevation. In similar fashion, a third respective inclined plane is defined at the rear side of the superstructure.

As a result of this novel arrangement of the superstructure of the mobile crane, the contour of the crane is always kept within a clearance gauge of the track section even when working in an uprighted attitude along the lengths of superelevated track. Collisions with vehicles on adjacent tracks or with tunnel walls along tracks running through tunnels are therefor safely prevented. Advantageously, the inventive railroad mobile crane is suitable for use on superelevated tracks within an entire 360-degree working range without limiting the load carrying capacity.

According to a further feature of the present invention, each of the two longitudinal sides of the superstructure and a rear side of the counterweight extend along the inclined plane. In this way, maximum use is made of allowable clearances.

According to another feature of the present invention, the superstructure is configured so that a maximum rear working radius of the superstructure is at most equal to half of a width of the crane. This ensures that during the swiveling of the crane no part of the superstructure ever projects outside of the inclined planes. In particular, the counterweight of the crane does not project beyond the inclined planes which define the contour of the superstructure.

The present invention accordingly corresponds to tightened regulations governing the use of railborne mobile cranes. The present invention makes it possible to safely use the crane, without limitations, along curved sections of track with compensation for superelevation, thereby enabling the full allotted carrying capacity to be utilized.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE PRESENTLY PREFERRED EMBODIMENTS

Figure 1:
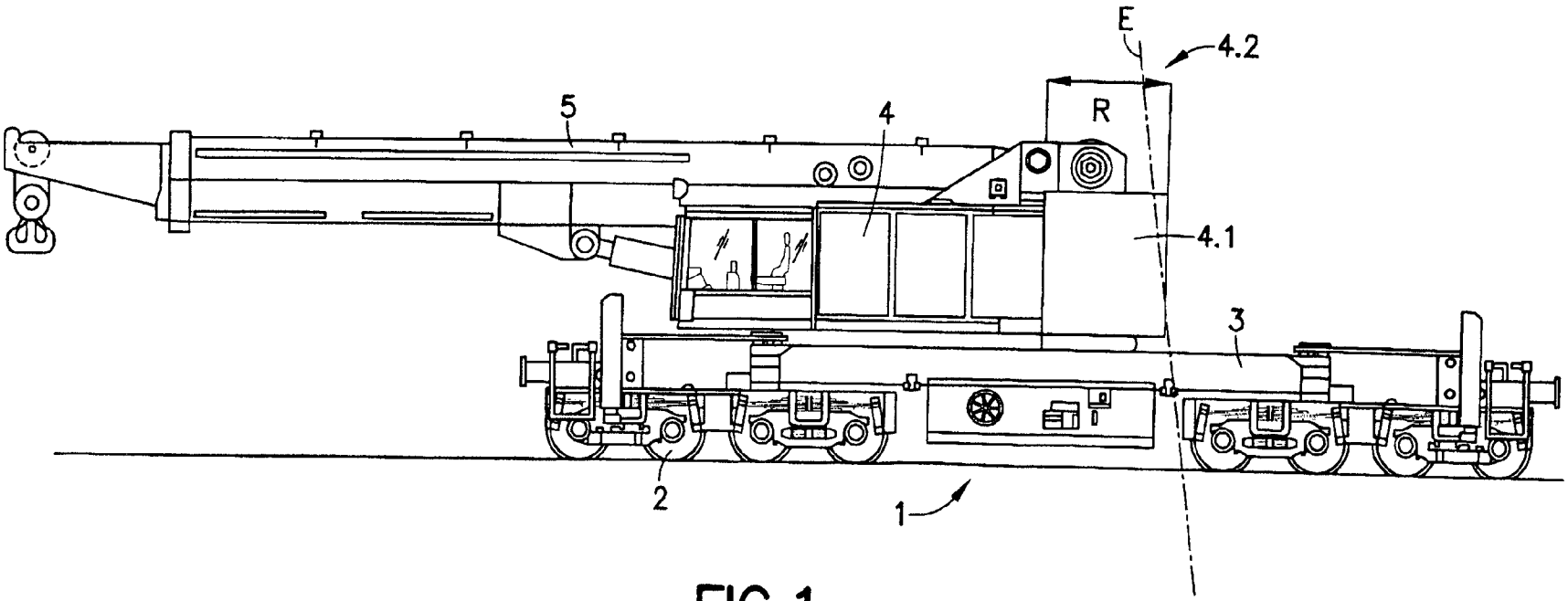
FIG. 1 shows a side view of a railborne mobile crane of the present invention.

FIG. 1 shows a side view of a railborne mobile crane 1 according to the present invention. The mobile crane 1 has a superstructure 4 which is rotatably mounted to a chassis 3. The chassis 3 in turn rests on a movement mechanism 2 so as to enable the mobile crane 1 to travel in a longitudinal direction along a railroad track. A boom 5 is fitted to the superstructure 4 in a raiseable and lowerable manner so as to lift a carrying load. The boom 5 extends past a front side of the superstructure 4. A counterweight 4.1 is arranged at a rear side of the superstructure 4 opposite to the extension of the boom 5. The counterweight 4.1 has a working radius 4.2, designated by R, which extends from a vertical axis of rotation of the superstructure 4 to an outer edge of a counterweight 4.1 and corresponds to half the width of the mobile crane 1.

Figure 2:
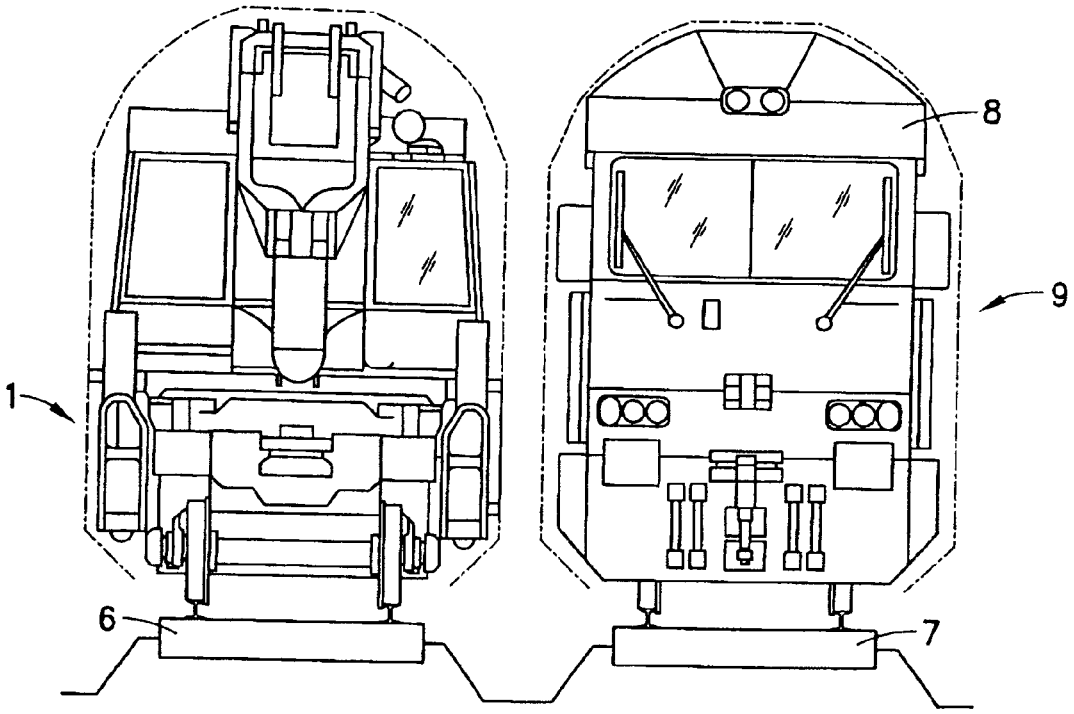
FIG. 2 shows a front view of the mobile crane according to FIG. 1, on a straight section of track.

FIG. 2 shows a front view of the mobile crane 1 according to the present invention, in which the mobile crane 1 is set up on a straight section of track 6 arranged in a horizontal plane. A railborne vehicle 8 is shown on an adjacent straight section of track 7 having contours within a permissible clearance gauge 9 which, for example, corresponds to UIC 505-3. Minimum spacing between the tracks 6, 7 is determined by construction codes and operating regulations of a railroad authority.

Figure 3:
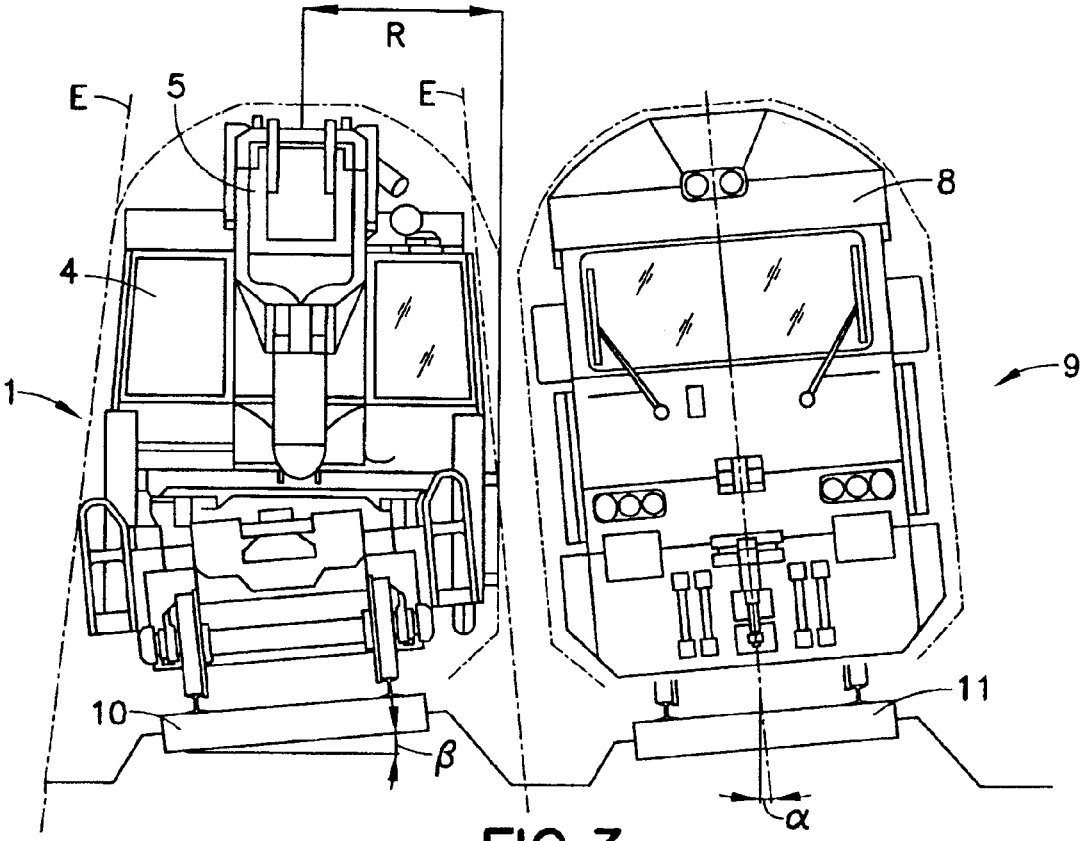
FIG. 3 shows the front view of the mobile crane according to FIG. 1, on a curved section of track.

FIG. 3 again shows the front view of the railborne mobile crane 1 according to the present invention, however this time on a curved track section 10 with a curve superelevation. As can be seen, the superelevation forms an angle of superelevation B with relation to the horizontal plane. The railborne vehicle 8 with a permissible clearance gauge 9 (e.g. UIC 505-3) is shown on an adjacent curved track section 11 which is at the same angle of superelevation B as the curved track section 10.

As shown, the mobile crane 1 has means 12 for compensation of curve superelevation (i.e. piston/cylinder members, which are activated, by known technology as for example by hydraulics, so as to vertically orient the chassis 3, the superstructure 4 and the boom 5 of the mobile crane 1. If the superstructure 4 is not angled at the longitudinal sides as in the present invention, the superstructure 4 would come dangerously close to or collide with the railborne vehicle 8 on the adjacent track 11. In this working situation, in view of the superelevation compensation means, and the configuration of the superstructure 4 according to the present invention, the mobile crane 1 is capable of unrestricted utilization of its carrying capacity, as the boom 5 is maintainable in a horizontal position.

Figure 4:
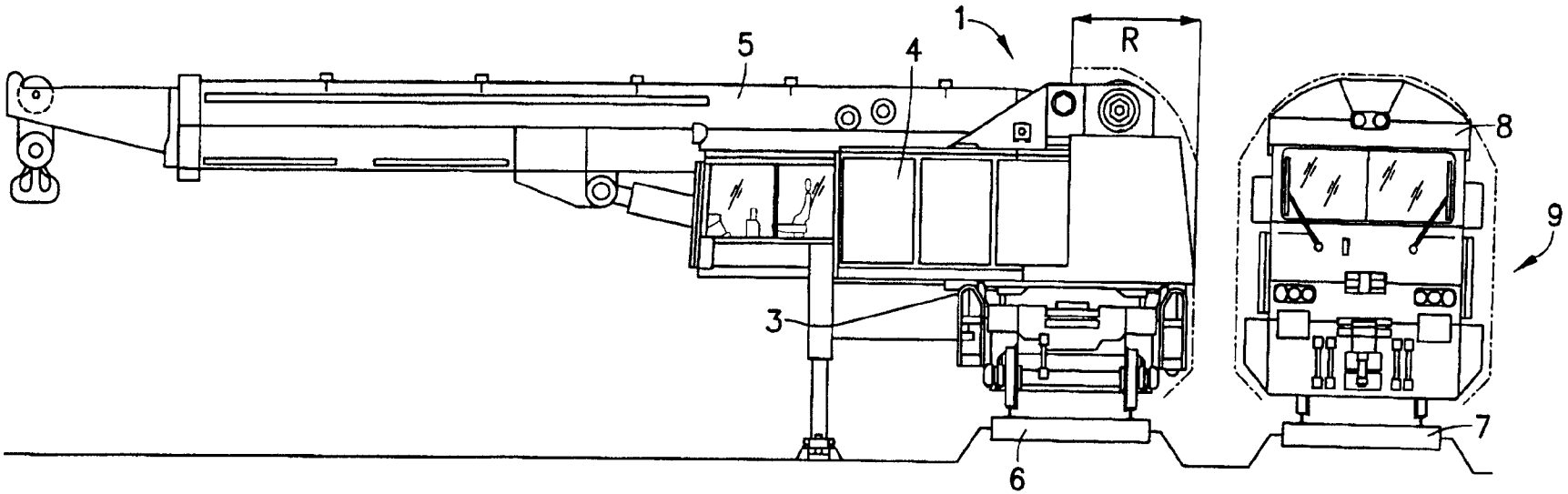
FIG. 4 shows the front view of the mobile crane according to FIG. 2, in a working position on the straight section of track.

FIG. 4 shows the working position of a mobile crane 1 according to the present invention on the straight section of track 6. The superstructure 4 and boom 5 are rotated by 90° relative to the chassis 3 away from the adjacent track 7. The railborne vehicle 8 with the permissible clearance gauge 9, for example UIC 505-3, is movable on the adjacent track 7, without contacting the mobile crane 1.

Figure 5:
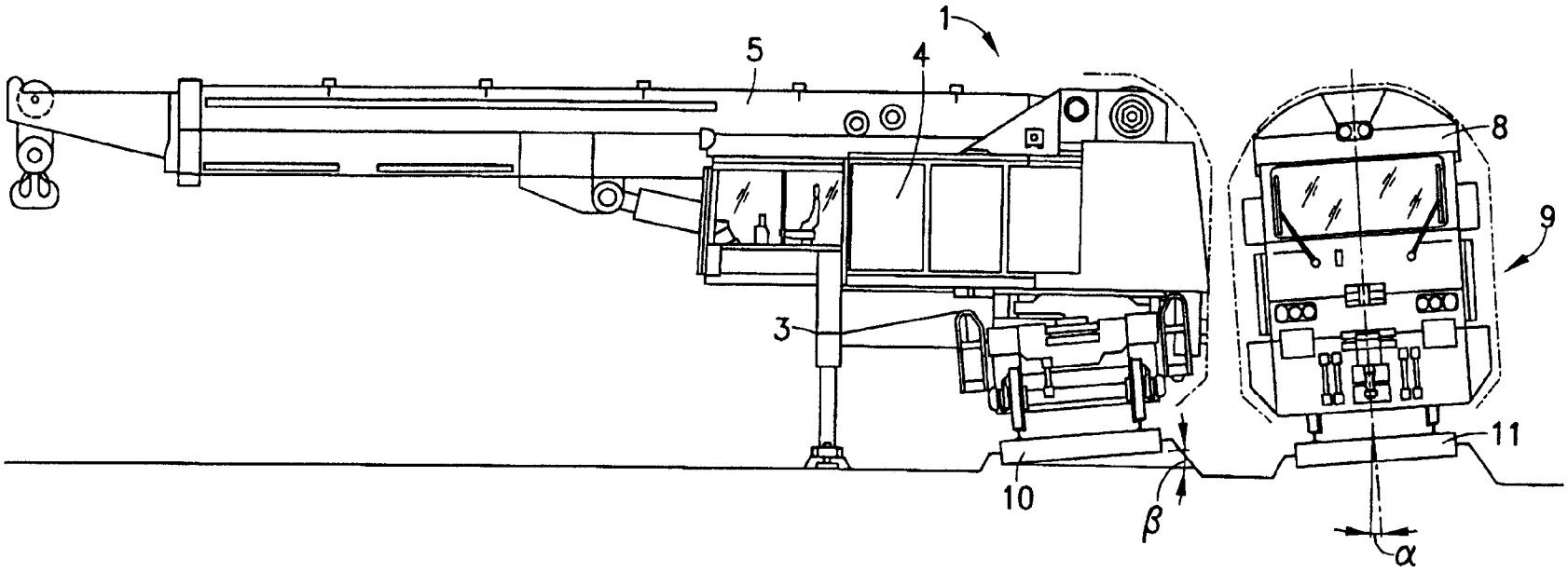
FIG. 5 shows the front view of the mobile crane according to FIG. 3, in the working position on the curved section of track.

FIG. 5 shows a view of the mobile crane 1 according to the present invention in the working position on the curved track section 10 with superelevation. The superstructure 4 and the boom 5 are rotated by 90° relative to the chassis 3, away from the adjacent track 11. A railborne vehicle 8 with the clearance gauge 9 is on the adjacent track 11. The known means for curve superelevation compensation is activated in the mobile crane 1 so that the chassis 3, the superstructure and the boom 5 of the mobile crane are oriented vertically. If the counterweight 4.1 at the rear working radius were not angled as in the present invention, the counterweight 4.1 would collide with the railborne vehicle 8 on the adjacent track 11. Advantageously, however, the configuration of the superstructure 4 according to the present invention, allows the boom 5 to be horizontally positioned thereby enabling the mobile crane in this working situation unrestricted utilization of its carrying capacity with superelevation compensation.

Therefore, the railborne mobile crane 1 of the present invention conforms to railroad authority safety regulations concerning maintenance of prescribed clearances.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A mobile crane including a device for compensating for curve superelevation, said mobile crane comprising:

a chassis; and a superstructure mounted on said chassis and swivelable about a vertical axis, said superstructure including a counterweight and having a back side formed by the counter-weight and opposed longitudinal sides, all of the sides being inclined relative to the vertical axis when the superstructure is on a non-superelevated track portion by an angle of inclination corresponding at least to an angle of maximum allowable track superelevation so that when the device for compensating for curve superelevation is utilized to level the superstructure, said sides of said superstructure are located within a prescribed clearance gauge.

2. The mobile crane of claim 1, wherein said crane has a width, said counterweight having a working radius equal to or smaller than half said width.

* * * * *